United States Patent [19]

Morgan

[11] 3,991,825

[45] Nov. 16, 1976

[54] SECONDARY RECOVERY SYSTEM UTILIZING FREE PLUNGER AIR LIFT SYSTEM

[76] Inventor: Thomas H. Morgan, 800 NW. Loop 410, 528 GPM Life N. Tower, San Antonio, Tex. 78216

[22] Filed: Feb. 4, 1976

[21] Appl. No.: 655,253

[52] U.S. Cl. ..... 166/68; 166/106; 417/118; 417/128; 417/138

[51] Int. Cl.[2] ..... F04F 1/06; E31B 33/03; E21B 43/00

[58] Field of Search ..... 166/68, 69, 106; 417/118, 120, 121, 143, 145, 128, 138

[56] References Cited

UNITED STATES PATENTS

| | | | |
|---|---|---|---|
| 298,990 | 5/1884 | Leedy | 417/118 |
| 1,596,303 | 8/1926 | Redfield | 417/143 |
| 3,106,170 | 10/1963 | Gray | 417/138 |
| 3,617,152 | 11/1971 | Cummings | 417/120 |
| 3,894,583 | 7/1975 | Morgan | 166/106 |
| 3,894,814 | 7/1975 | Morgan | 417/121 |
| 3,941,510 | 3/1976 | Morgan | 166/106 |

*Primary Examiner*—James A. Leppink
*Attorney, Agent, or Firm*—Cox, Smith, Smith, Hale & Guenther Incorporated

[57] ABSTRACT

The present invention is a secondary recovery system normally used for retrieving oil from the producing zone after the bottom hole pressure has decreased so that artificial lift is required for production. An accumulator is positioned in the lower portion of the casing where oil will accumulate from the producing zone. A standing valve is located in the bottom of the accumulator to prevent oil collected therein from leaving the accumulator. Above the accumulator is located a free floating piston having passageways therethrough. By proper control of the pressure line from the surface, oil is gradually moved through the free floating piston into a production tubing thereabove. Next, again in response to surface control, the free floating piston and oil collected thereabove is moved to the surface of the well by a rapid pressurization of the accumulator. Thereafter, pressure is exhausted from the accumulator allowing the piston to drop back to its lowermost position immediately above the accumulator. All movable parts in the well are retrievable from the surface without pulling the production tubing.

7 Claims, 5 Drawing Figures

SECONDARY RECOVERY SYSTEM UTILIZING FREE PLUNGER AIR LIFT SYSTEM

BACKGROUND OF THE INVENTION

This invention relates to a secondary recovery process for petroleum production and, more particularly, to an artificial lift system utilizing a free floating plunger being raised by pressurized air. The secondary recovery system described in the present invention has a minimum amount of apparatus located in the well. The few components located in the well are easily recoverable from the surface.

The present invention is an improvement over U.S. Pat. Nos. 3,894,814 and 3,894,583, both of which have the same inventor as the present application, and are hereby incorporated by reference. Copies of the incorporated patents are attached for the convenience of the Examiner.

DESCRIPTION OF THE PRIOR ART

The various steps in the productive life of an oil well were described in considerable detail in the incorporated references. Normally when the production from an oil well has dropped to around 5 to 10 barrels per day, it may be uneconomical to continue production from that particular well depending upon its depth and various other factors. A common system used in the past was to have a piston located in the production tubing immediately above the accumulator. Once the accumulator was filled, pressure could be applied forcing the oil up around and above the piston. Thereafter the piston was moved by any means, such as pulling a wire line connected to the piston, from the lowermost position in the well to move both the piston and oil to the surface. At the surface the oil above the piston would flow into the collection tank and, thereafter, the piston would be allowed to drop back to its normal position.

Various types of bypass devices and crossovers have been used to move the oil from the accumulator to above the piston. Many of these systems required complicated apparatus in the well near the producing zone. The more apparatus that was contained in the well, the more likely the system would fail. Each valve that was located in the bottom of a well had a tendency to stick or clog up as time passes.

A further problem with the prior art was that many of the components were not retrievable from the surface without pulling an entire string of pipe. For example, gas lift valves had a tendency to stick, but were not retrievable from the surface without pulling the string of pipe. Many other valves and moving parts located in the well were also nonretrievable from the surface without pulling the pipe.

In prior systems using free floating pistons many of the controls for the free floating piston were located in the well. These controls may consist of bypass valves, pressure valves or other moving parts located in the well.

The control portion as shown in the prior art would normally have some type of pressurized gas available for lifting a free floating piston and oil located thereabove to the surface. These control devices would consist of a single pressure valve for raising the piston and oil thereabove to the surface, and an exhaust valve for venting the accumulator to atmosphere.

SUMMARY OF THE INVENTION

The present invention is directed towards a secondary recovery system utilizing a free floating plunger in an air lift system. An accumulator is located in the area where oil will naturally accumulate from the producing zone. A standing valve in the bottom of the accumulator prevents oil accumulated therein from flowing back to the producing zone. Located above the accumulator is a free floating piston (commonly called plunger with the terms "piston" and "plunger" being used interchangeably herein) that has a limited flow passage therethrough. A transfer tube extends below the free floating piston towards the bottom of the accumulator. An air line extends from the accumulator to the surface and is connected to a pressure control apparatus on the surface.

The pressure control apparatus has three valves with the first valve allowing exhaust from the accumulator via the air line to atmosphere. Another valve, after the closure of the exhaust valve, may be opened to provide a gradual pressurization of the accumulator via the air line thereby slowly moving the oil through the transfer tube, through the limited flow passage, and above the free floating piston. Once the oil has been moved above the free floating piston, the second valve is closed and a large pressurization valve is opened to rapidly move the free floating piston and oil located there above the surface.

In the event of a mechanical failure of some moving part located in the well, these moving parts (consisting of the free floating piston, transfer tube check valve and standing valve) may be quickly retrieved to the surface and replaced or repaired. If the standing valve becomes clogged, many times it may be possible to clear the standing valve with a blast of air through the air line from the surface.

Therefore, it is the object of the present invention to provide a secondary recovery process utilizing a free floating piston in an air lift system.

It is a further object of the present invention to provide a secondary recovery process that utilizes the minimum amount of equipment in the well, thereby reducing the probability of malfunction and expense of retrieval of components therefrom.

It is still another object of the present invention to provide a secondary recovery process wherein oil collected in an accumulator is moved above a piston and raised to the surface by means of an air line controlled from the surface.

It is yet another object of the present invention to provide a control mechanism for a secondary recovery process wherein an accumulator is (1) exhausted to atmosphere, (2) slowly pressurized to move oil through a transfer tube and through a free floating piston to the production tubing thereabove, and (3) to rapidly pressurized thereby raising the free floating piston and oil thereabove to the surface.

It is yet another object of the present invention to have all moving components located in the well retrievable from the surface without the necessity of pulling a string of production tubing or pipe from the well.

It is even another object of the present invention to provide a time control mechanism wherein an air line connected to the accumulator is timed so that after sufficient oil has collected in the accumulator, the vent of the air line to atmosphere is closed and the accumulator is slowly pressurized through the air line from a source of pressurized air located on the surface. Thereafter, when sufficient time has lapsed for moving the oil from the accumulator above a free floating piston, a large amount of pressurized air is fed through the air line to the accumulator thereby raising the piston and the oil located thereabove to the well head. After the necessary time to raise the piston to the well head has elapsed, further pressurization will be terminated and the accumulator exhausted to atmosphere thereby allowing the free floating piston to fall back to its normal location immediately above the accumulator.

The free floating piston has a passage therethrough with appropriate valving mechanism to allow slow passage of fluids through the piston. However, if a large amount of fluid is moved through the passage, the valving mechanism will close the passage until the pressure differential across the piston is removed. A similar such piston or plunger is sold by McMurry Oil Tools, Inc. and is commonly called a "McMurry Plunger." A copy of a typical advertising information sheet for the McMurry Plunger is enclosed herewith for the Examiner.

DESCRIPTION OF THE PREFERRED ENBODIMENT

Figure 1:
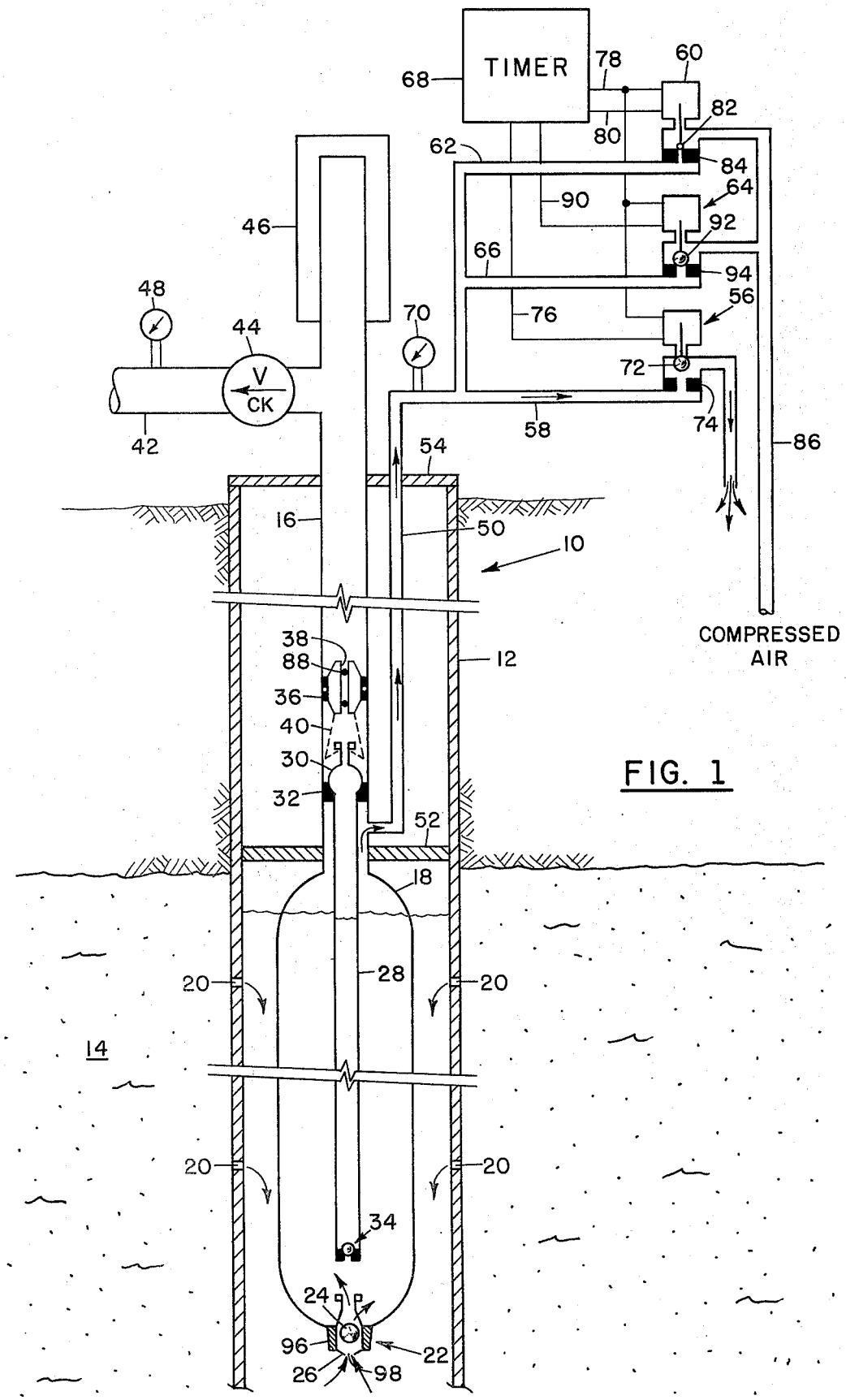
FIG. 1 is an elevated sectional view of the secondary recovery system and associated controls exhausting the accumulator to atmosphere.

Referring now to FIG. 1 of the drawing, there is shown a typical petroleum well, represented generally by the referenced numeral 10, which requires secondary lift for production. The well 10 has a casing 12 located therein which extends into the oil producing zone 14. Inside of the casing 12 there is located production tubing 16 which also extends down to the oil producing zone 14. On the end of the production tubing 16 is located an accumulator 18. If necessary, perforations 20 are contained in the casing 12 to allow oil from the oil producing zone 14 to flow inside the casing 12 by normal underground pressures. The oil inside of the casing 12 enters the accumulator 18 through standing valve 22. Once oil has been collected in the accumulator 18, it may not flow therefrom because the standing valve 22 is a one way check valve. If a fluid starts to flow from the accumulator 18, the ball 24 would come to rest against the seat 26 thereby stopping reverse flow.

Inside of the accumulator 18 is located a transfer tube 28. The transfer tube 28 is held into position by enlarged portion 30 located at the top thereof. The enlarged portion 30 rests against seat 32 which holds the transfer tube 28 in place. While the transfer tube 28 shows a check valve 34 located in the bottom thereof, the check valve 34 is an optional feature that may or may not be included.

Above the transfer tube 28 is located a free floating piston 36 which has a limited flow passage 38 therethrough. The free floating piston 36 rests against the spring catcher 40 which prevents damage to the transfer tube 28 upon piston 36 falling to the normal position shown in FIG. 1.

At the surface of the well 10 is located a flow line 42 which is connected to the production tubing 16. Inside of the flow line 42, and adjacent to the production tubing 16, is a check valve 44 to prevent reverse flow into the production tubing 16. At the top of the production tubing is located what is commonly called a "piston catcher" 46 which stops the upward movement of the free floating piston 36. A pressure gauge 48 monitors the pressure in the flow line 42.

An air line 50 also connects to the accumulator 18 via the lowermost portion of the production tubing 16 immediately above packer 52. The accumulator 18 and production tubing 16 are held in a stable position by packer 52 with communication via air line 50 being immediately below the seat 32 located in the production tubing 16. On the surface, the air line 50 is connected to a total of three valves. An exhaust valve 56 is connected to air line 50 via exhaust line 58. A pilot valve 60 is connected to air line 50 via pilot line 62. Also, a drive valve 64 is connected to air line 50 via pressure line 66. Controlling each of the valves 56, 60 and 64 is a timer 68 that will be described in more detail subsequently. Monitoring the pressure of air line 50 is a pressure gauge 70. The typical petroleum well 10 may or may not have a sealed cap 54.

The following paragraphs will be directed towards the sequence of steps that occur in the secondary recovery process of the present invention. Referring now to FIG. 1 of the drawings, the accumulator 18 is connected to atmosphere via air line 50, exhaust line 58 and exhaust valve 56. Notice that the ball 72 of exhaust valve 56 is not located against its seat 74. The movement of the ball 72 is controlled by energization from the timer 68 through connection 76 and ground 78. Pilot valve 60 and drive valve 64 are closed. Oil has collected in the accumulator 18 until accumulator 18 is approximately full.

Figure 2:
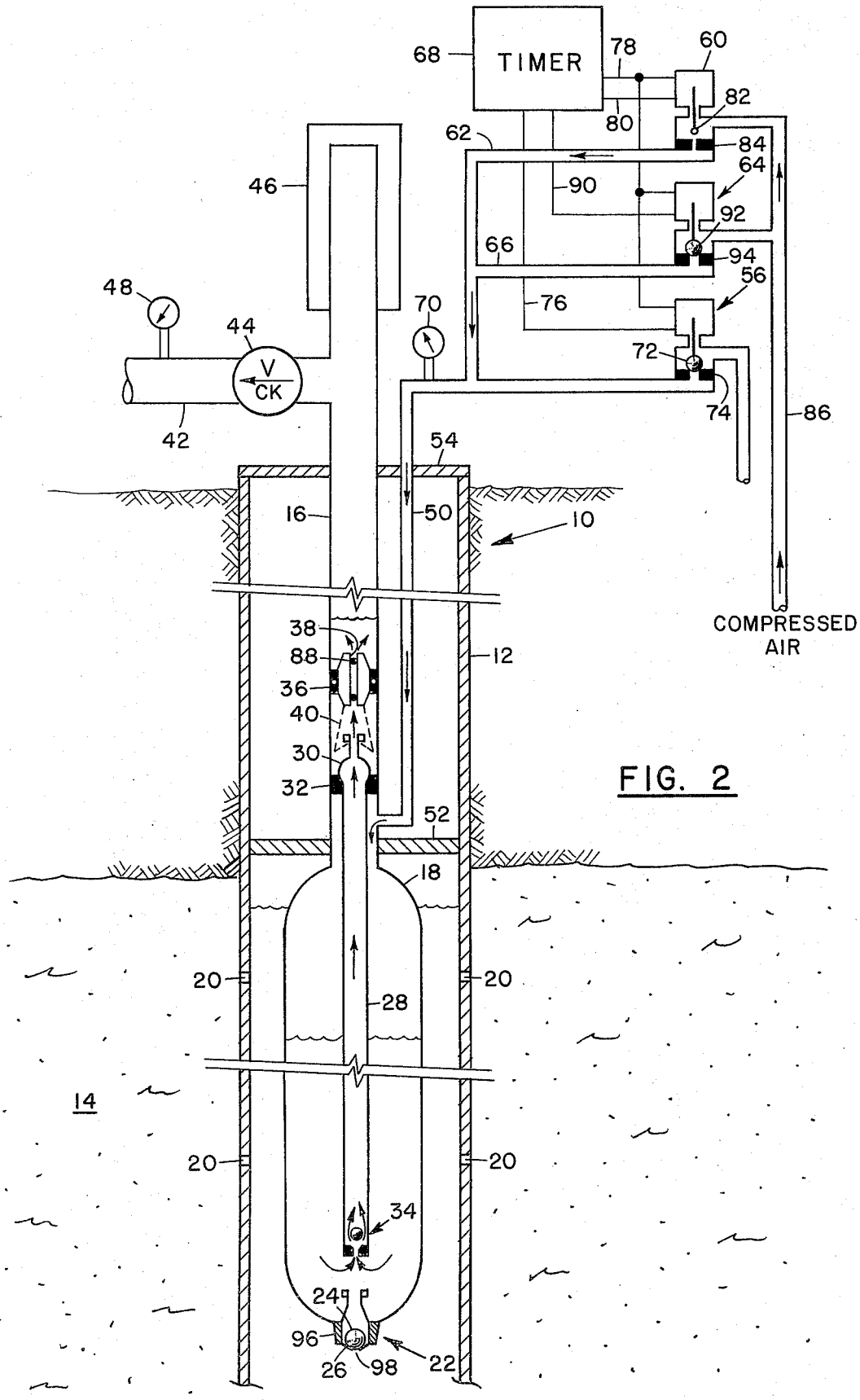
FIG. 2 is an elevated sectional view of the secondary recovery system with the associated controls moving the oil from the accumulator to above the free floating piston.

Referring now to FIG. 2 of the drawing, like components are given the same number designation as in FIG. 1. In FIG. 2 the control voltage for exhaust valve 56 has been removed thereby causing ball 72 to seat and shut off the exhaust to atmosphere. Subsequently, a control voltage is supplied to pilot valve 60 via connection 80 to energize the valve 60 thereby moving ball valve 82 away from its seat 84. It should be realized that the pilot valve 60, and its related ball valve 82 and seat 84, is a restricted valve that will only allow a limited amount of flow therethrough. The opening of pilot valve 60 connects the pilot line 62 to compressed air line 86. This allows a source of pressurized air to gradually flow through pilot valve 60, pilot line 62 and air line 50 into accumulator 18. By the gradual flow of the pressurized air, accumulator 18 will be gradually pressurized thereby forcing the oil downward, closing the standing valve 22, and up through the transfer tube 28. As long as the pressurization of accumulator 18 is fairly slow, the oil being moved upward through transfer tube 28 will flow through limited flow passage 38 of free floating piston 36. If too much pressure is exerted on accumulator 18 thereby generating a rapid flow of oil through the limited flow passage 38, valve 88 contained therein will close thereby preventing a further flow of oil through the free floating piston 36. However, by using a pilot valve 60 which has limited flow capability in conjunction with a control signal from timer 68, the oil inside of accumulator 18 can gradually be moved above free floating piston 36 as is illustrated in FIG. 2.

Figure 3:
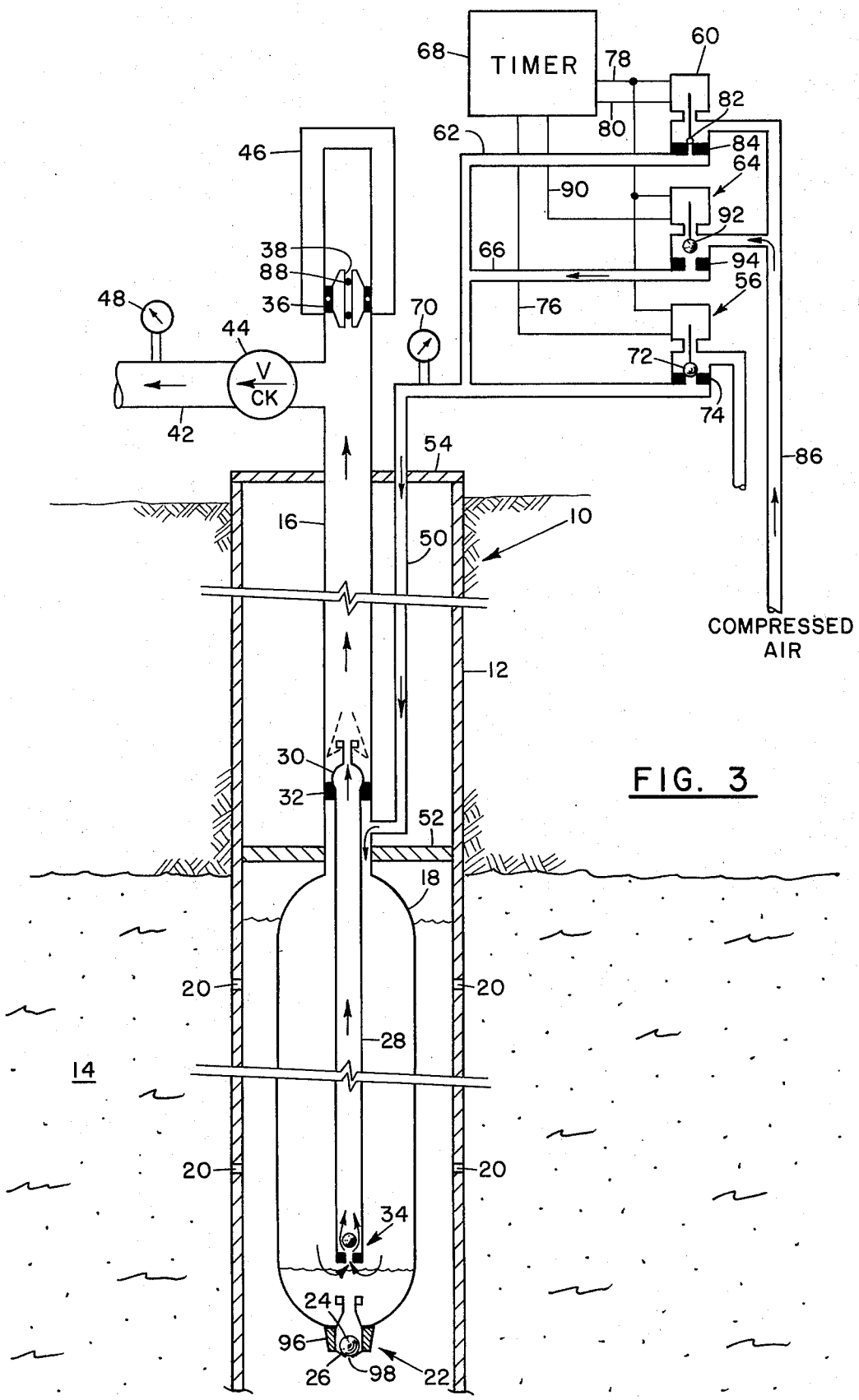
FIG. 3 is an elevated sectional view of the secondary recovery system and associated controls with the high volume of pressurized air moving the free floating piston and oil to the well head.

Referring now to FIG. 3, like numerals will be used to designate like components as was previously described in conjunction with FIG. 1 and 2. In FIG. 3, the energization for pilot valve 60 via connection 80 has been terminated, thereby permitting the ball 82 to seat and prevent further pressurization of the accumulator 18 through the pilot valve 60. At approximately the same time as the closing of pilot valve 60 or shortly thereafter, drive valve 64 will be energized via connection 90 and ground 78 from timer 68. The voltage from the timer 68 will cause the pilot valve 64 to unseat ball 92 from its seat 94. This rapid pressurization through a rather large drive valve flows very rapidly through the pressure line 66 and air line 50 to the accumulator 18. This causes a surge of oil through the limited flow passage 38 of free floating piston 36 thereby causing valves 88 to close. Further pressurization will then raise free floating piston 36 and oil accumulated thereabove to the surface of the well 10. As the oil located above free floating piston 36 reaches the surface, it will flow through check valve 44 into flow line 42. The flow of the oil can be visually monitored by pressure gauge 48. The pressure in flow line 42 will increase when the oil is flowing therethrough. After a sufficient period of time has elapsed that the free floating piston 36 has reached the piston catcher 46, and all the oil located thereabove has entered flow line 42, the timer 68 will deenergize drive valve 64 thereby shutting off the connection between the compressed air source and air line 50. Afterwards the exhaust valve 56 will be energized to unseat ball 72 from seat 74 thereby reconnecting accumulator 18 to atmosphere. The reconnection of accumulator 18 to atmosphere will remove the pressure on free floating piston 36 which will allow valves 88 located therein to open. In this manner the free floating piston 36 would drop back to its normal position as shown in FIG. 1. Any oil contained in the production tubing 16 flows through the valves 88 of limited flow passge 38 as the piston 36 falls downward.

The apparatus as previously described in conjunction with FIG. 1 through 3 has a very limited number of moving parts located in the well 10. The free floating piston 36 and its internal valves 88 located therein can very easily be moved to the surface of the well by pressurization therebelow. If there is some malfunction in the valves 88, free floating piston 36 can be easily retrieved by a line from the surface. Likewise, transfer tube 28 and spring catcher 40 may also be retrieved from the surface by means of a line extended into the well 10. The enlarged portion 30 is merely resting against seat 32. Further, standing valve 22 rests against an inward flare 96 around opening 98 in the bottom of accumulator 18. After free floating piston 36 and transfer tube 28 have been retrieved by means of a line, standing valve 22 may also be retrieved. It is possible that standing valve 22 may be connected to transfer tube 28 so that when transfer tube 28 is retrieved standing valve 22 will automatically be retrieved also. At the surface of the well, any of the moving parts previously located in the well may be cleaned or replaced, such as the standing valve 22, check valve 34 or valves 88 of free floating piston 36. If there is a problem with standing valve 22 becoming clogged, many times it is possible to clear up the clogging by a simple blast of high pressure air through air line 50. The retrievability of all the moving parts from the well 10 without the necessity of pulling production tubing or other pipes greatly reduces the maintenance cost of the present invention over prior systems.

Figure 4:
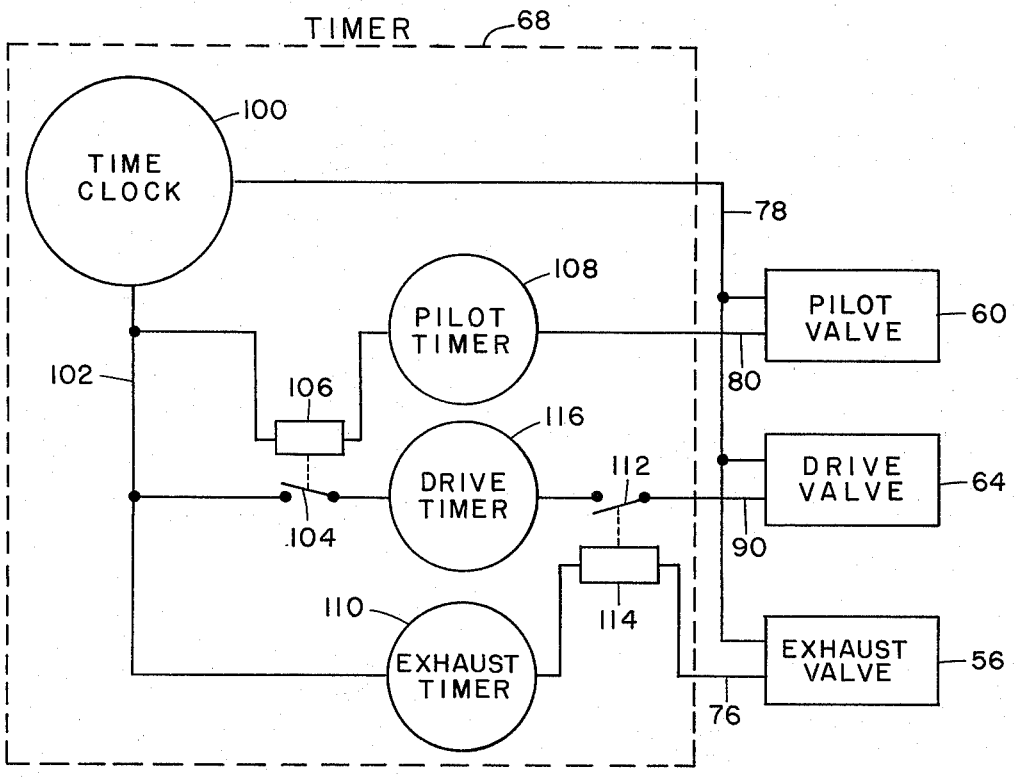
FIG. 4 is the control portion of the secondary recovery system.

Referring now to FIG. 4 of the drawings, the timer 68 will be described in more detail. As part of the timer 68 it is necessary to have a time signal generated by a time clock 100. The ground 78, which connects to pilot valve 60, drive valve 64 and exhaust valve 56, is connected to time clock 100. The time clock 100 is a standard item that can be bought off the shelf as well as all other items illustrated in FIG. 4. After a certain time has elapsed, time clock 100 will generate a control signal via connection 102. The control signal 102 will immediately open switch 104 via solenoid 106. The control signal 102 is also fed to pilot timer 108. From pilot timer 108, pilot valve 60 is energized a predetermined period of time as controlled by the pilot timer 108. The exhaust timer 110 acts just the opposite from the pilot timer 108 in response to the control signal. In response to the control signal from the time clock 100, exhaust timer 110 removes its output control signal thereby allowing switch 112 controlled by solenoid 114 to close and for exhaust valve 56 to close by removing voltage therefrom.

After the time set in the pilot timer 108 has elapsed, which time should approximately equal the time required to move the oil in accumulator 18 to above the free floating piston 36, the energization for pilot valve 60 will be removed thereby allowing it to close. Since current is no longer flowing through solenoid 106, switch 104 will also close. Now with switch 104 and 112 closed, the drive timer 116 will energize thereby opening drive valve 64. The opening of drive valve 64 will cause the free floating piston 36 and oil located thereabove to move to the surface of the well as illustrated in FIG. 3. The time set in drive timer 116 should approximately equal the period of time necessary for the free floating piston 36 to reach the surface. Afterwards drive valve 64 will be closed by the drive timer 116. Exhaust timer 110 gives an output signal to exhaust valve 56 only if there is not a control signal from time clock 100. The time clock 100 will automatically reset and remove the voltage from connector 102. This will allow switch 112 to be opened along with exhaust valve 56. This will remove pressurization from accumulator 18 and production tubing 16 and allow the free floating piston 36 to fall back to its lowermost position.

The time periods to be set into the time clock 100, pilot timer 108, drive timer 116 and exhaust timer 110 can be determined by watching the pressure gauges 48 and 70. For example when pilot valve 60 is open, pressure gauge 70 will show a higher pressure while oil is being moved through the transfer tube 28 to the above piston 36. But upon moving all of the oil above the piston 36 there will be a drop in the pressure indicated on pressure gauge 70 caused by air blowing through the free floating piston 36. Likewise, when the free floating piston 36 reaches the surface and oil flows through flow line 42, there will be a marked increase in the pressure indicated on pressure gauge 48. Therefore, the time has been determined for the setting of the pilot timer 108 and drive timer 116. The exhaust timer 110 should be set at some time period exceeding the pilot timer 108 and drive timer 116 together. As to the appropriate setting for the time clock 100, this can be very easily determined by the volume of flow through flow line 42 versus the volume of the accumulator on any given stroke of the piston 36. The flow through flow line 42 should approximately equal the volume of the accumulator to insure maximum efficiency.

Figure 5:
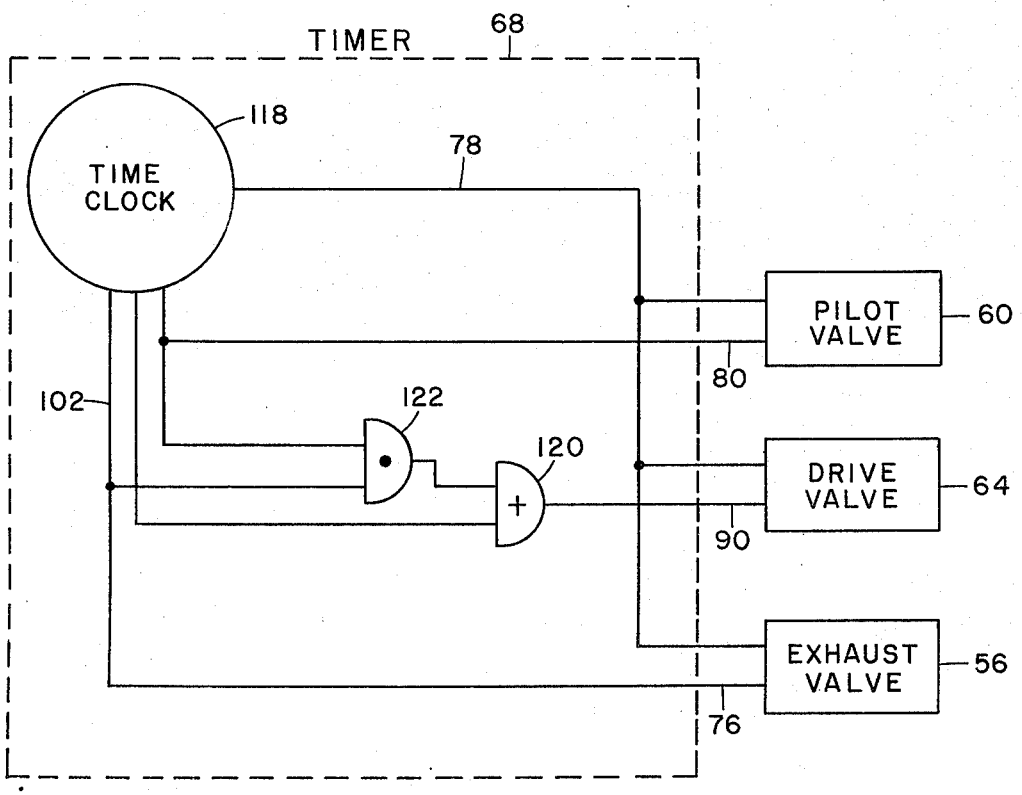
FIG. 5 is an alternative control portion for the secondary recovery system.

FIG. 5 shows an alternative timer which may not be commonly used in oil field production equipment. A time clock 118, which consists of a free running oscillator or crystal located therein, is designed to give a series of three outputs at different time intervals. The time intervals for the various outputs can be controlled by a manner well known in the state of the art by proper adjustments to components of the time clock 118, such as variable resistors. Time clock 118 would be set so that a first control signal is sent to exhaust valve 56. This control signal maintains exhaust valve 56 in the open position while the accumulator 18 fills with oil. Thereafter the first control signal is removed and exhaust valve 56 is closed. Subsequently, a second control signal is sent to pilot valve 60 causing pilot valve 60 to open. The second control signal is maintained for a predetermined period of time to maintain the pilot valve 60 in the open position. After the first and second control signals have been removed, a third control signal is fed into an AND gate 120. Another input for the AND gate 120 is received from NOR gate 122. As a safety feature, NOR gate 122 will only give an output if both the first and second control signals which are fed into NOR gate 122 have been terminated. AND gate 120 will only give an output to actuate drive valve 64 if it has both input signals, which means the first and second control signal must have been terminated and the third control signal have started. This prevents the pressurized air from the source of compressed air from blowing through pilot valve 60 or exhaust valve 56 in case of malfunction. While the control equipment described in FIG. 5 may be different from that previously described in conjunction with FIG. 4, the time clock 118 may also be set by visually observing pressure gauges 48 and 70.

I claim:

1. A system of secondary recovery of oil from a petroleum well, said system including:

production tubing extending from a wellhead to an oil producing zone of said well;

accumulator means located in said oil producing zone of said well, said accumulator means being attached to a lowermost end of said production tubing;

standing valve in the bottom of said accumulator means to allow flow therethrough only into said accumulator;

transfer tube extending from said production tubing to near the bottom of said accumulator;

piston means having a limited flow passage therethrough, said piston means slidably located in said production tubing between said transfer tube and said wellhead;

flow line means connected to said production tubing at said wellhead for receiving oil from said production tubing;

pressure/exhaust line extending from said wellhead to said accumulator;

control means connected to the wellhead end of said pressure/exhaust line, said control means having a timer means for periodically energizing at least three surface valves;

a first of said surface valves first connecting said pressure/exhaust line to atmosphere for a first predetermined time period to allow said accumulator to fill with oil;

a second said surface valves secondly connecting said pressure/exhaust line to a source of pressurized gas for a second predetermined time period to allow said accumulator to be slowly pressurized thereby moving said oil through said transfer tube and said limited flow passage into said production tubing above said piston;

a third of said surface valves thirdly connecting said pressure/exhaust line to said source of pressurized gas for a third predetermined time period for rapid pressurization of said accumulator, said rapid pressurization causing limiting valves in said limited flow passage to close and said piston and oil located thereabove to move to said wellhead during said third predetermined time period, afterwards said pressure/exhaust line being reconnected to atmosphere which allows said limiting valves to open and said piston means to fall back to its lowermost position to repeat the cycle.

2. The system of secondary recovery as recited in claim 1 wherein said control means includes means for preventing said rapid pressurization of said accumulator if said first or second surface valves are open.

3. The system of secondary recovery as recited in claim 2 wherein said second surface valve is a small valve to allow only limited flow therethrough.

4. The system of secondary recovery as recited in claim 3 wherein said pressurized gas is air, said pressure/exhaust line connecting to said accumulator means via the lowermost portion of said production tubing with a packer means extending around said lowermost portion to hold said production tubing and said accumulator means in position.

5. The system of secondary recovery is recited in claim 1 wherein said standing valve and said transfer tubing are retrievable from said wellhead by a line.

6. The system of secondary recovery as recited in claim 5 wherein said transfer tube has an enlarged upper portion resting against a seat in said production tubing, said transfer tube having a check valve in the lower end thereof.

7. The system of secondary recovery as recited in claim 1 wherein said pressure/exhaust line and said flow line means include pressure gauges connected thereto, length of said first and second predetermined time periods are set by observing said pressure gauges during operation.

* * * * *